US011744338B2

(12) United States Patent
Dawe

(10) Patent No.: US 11,744,338 B2
(45) Date of Patent: Sep. 5, 2023

(54) JEWELRY STORAGE CASE

(71) Applicant: Blingo Bags Ltd., Aurora (CA)

(72) Inventor: Julia Catherine Dawe, Aurora (CA)

(73) Assignee: Blingo Bags Ltd., Aurora (CA)

( * ) Notice: Subject to any disclaimer, the term of this patent is extended or adjusted under 35 U.S.C. 154(b) by 411 days.

(21) Appl. No.: 16/804,160

(22) Filed: Feb. 28, 2020

(65) Prior Publication Data

US 2020/0275750 A1 Sep. 3, 2020

(30) Foreign Application Priority Data

Mar. 1, 2019 (CA) ..... 3035355

(51) Int. Cl.
*A45C 11/16* (2006.01)
*A45C 13/02* (2006.01)

(52) U.S. Cl.
CPC ..... *A45C 11/16* (2013.01); *A45C 13/02* (2013.01); *A45C 2013/026* (2013.01)

(58) Field of Classification Search
CPC ..... A45C 11/16; A45C 11/34; A45C 11/38; A45C 13/10; A45C 13/1023; A45C 13/103; A45C 13/02; A45C 2013/026; B65D 25/08; B65D 2581/055; B65D 81/051; B65D 81/261; B25H 3/02; B25H 3/026; B25H 3/028; B25H 3/04; B25H 3/06; A47F 7/00
See application file for complete search history.

(56) References Cited

U.S. PATENT DOCUMENTS 4,386,642 A * 6/1983 Durbin ..... A61F 17/00 190/110
4,733,806 A * 3/1988 Sloop ..... A45F 3/02 224/601
5,050,733 A * 9/1991 Brennan ..... B25H 3/06 206/561
5,484,092 A * 1/1996 Cheney ..... B60R 9/00 312/222
5,950,815 A * 9/1999 Yetman-Bellows ... A47G 1/143 211/85.2
6,685,023 B2 * 2/2004 Bleggi ..... A45C 11/16 211/85.2
7,182,416 B1 * 2/2007 Greiner ..... A47F 7/02 312/309
2003/0062285 A1 * 4/2003 Bleggi ..... A45C 11/16 206/493
2004/0040918 A1 * 3/2004 Moore ..... B25H 5/00 211/13.1

(Continued)

FOREIGN PATENT DOCUMENTS

CA 2846814 A1 * 9/2014 ..... B25H 3/06
DE 202012103501 U1 * 11/2012 ..... B25H 3/02

(Continued)

*Primary Examiner* — J. Gregory Pickett
*Assistant Examiner* — Abigail Elizabeth Guidry
(74) *Attorney, Agent, or Firm* — Rowand LLP

(57) ABSTRACT

A jewelry storage case comprises a first portion having a first surface and a wall extending from a periphery of the first surface; a base having a generally planar surface and positioned on the first surface of the first portion; and a plurality of projections extending upward from the planar surface of the base, the projections spaced apart from one another to receive a portion of jewelry.

17 Claims, 9 Drawing Sheets

(56) References Cited

U.S. PATENT DOCUMENTS

| | | | | |
|---|---|---|---|---|
| 2005/0023164 | A1* | 2/2005 | Hung | B25H 3/06 206/349 |
| 2007/0144986 | A1* | 6/2007 | Hill | B25H 3/06 211/70.6 |
| 2008/0078687 | A1* | 4/2008 | Weng | A45C 5/03 206/521 |
| 2008/0264815 | A1* | 10/2008 | Allen | A45C 13/103 206/315.11 |
| 2012/0222932 | A1* | 9/2012 | Wang | A45C 5/03 190/110 |
| 2014/0048428 | A1* | 2/2014 | Sakamoto | A45C 11/16 206/6.1 |
| 2020/0353612 | A1* | 11/2020 | McCune | B65D 81/051 |

FOREIGN PATENT DOCUMENTS

| | | | | |
|---|---|---|---|---|
| DE | 202018105528 | U1 * | 2/2020 | A45C 13/001 |
| FR | 1378395 | A * | 11/1964 | B25H 3/02 |

* cited by examiner

JEWELRY STORAGE CASE

TECHNICAL FIELD

The present application relates to jewelry storage and in particular to jewelry storage cases.

BACKGROUND

Jewelry is often stored in jewelry storage cases which may be stationary and/or portable. Some jewelry storage cases store multiple pieces of jewelry in a single compartment which can cause the jewelry to become disorganized and/or entangled.

Some jewelry storage cases contain multiple compartments, wherein each compartment is designed to store a single piece of jewelry. Although the single piece of jewelry is stored on its own, it may become entangled with itself.

Improvements in jewelry storage cases are desired.

BRIEF DESCRIPTION OF THE DRAWINGS

Embodiments are described in detail below, with reference to the following drawings.

Like reference numerals are used in the drawings to denote like elements and features.

DETAILED DESCRIPTION OF VARIOUS EMBODIMENTS

Figure 1:
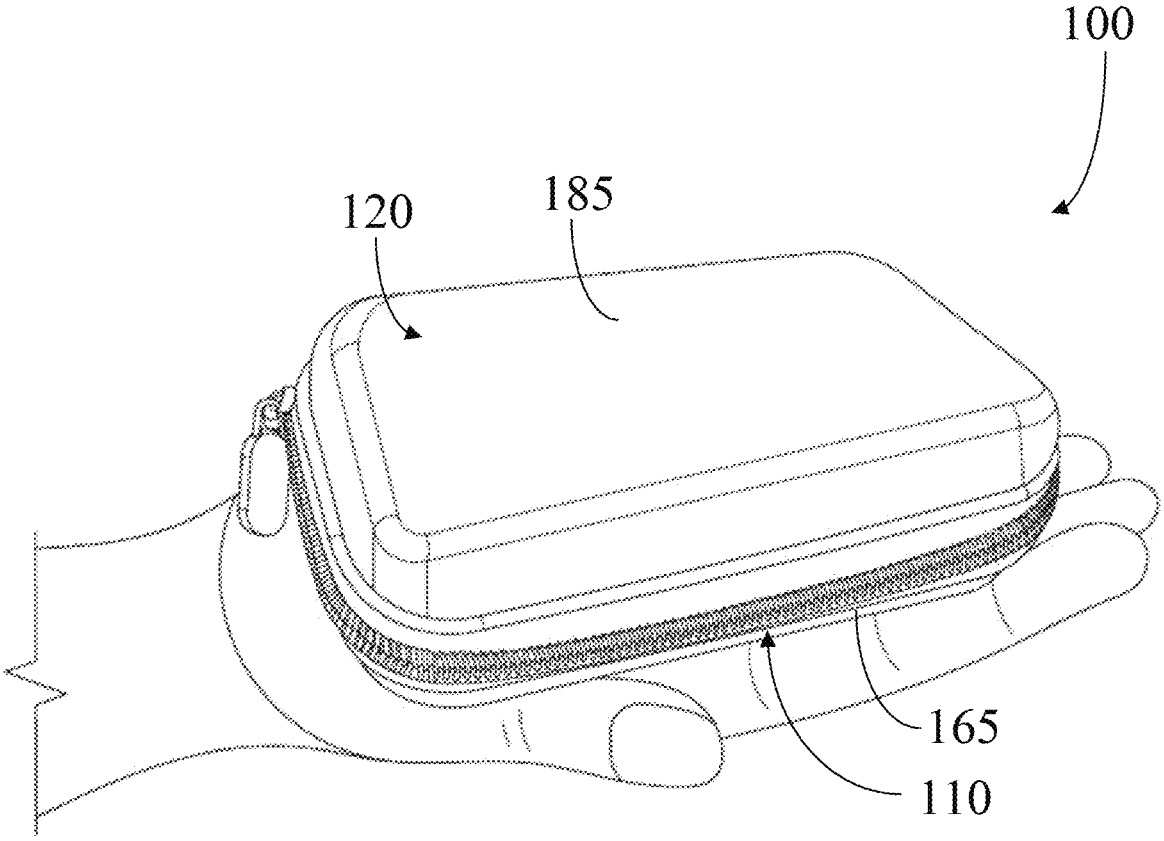
FIG. 1 is an isometric view of the jewelry storage case in a closed position according to an exemplary embodiment.

According to an aspect, there is provided a jewelry storage case comprising a first portion having a first surface and a wall extending from a periphery of the first surface; a base having a generally planar surface and positioned on the first surface of the first portion; and a plurality of projections extending upward from the planar surface of the base, the projections spaced apart from one another to receive a portion of jewelry.

In one or more embodiments, each projection extends upward from the planar surface perpendicularly.

In one or more embodiments, each projection comprises a body connected at one end to the planar surface.

In one or more embodiments, an opposite end of each projection comprises a rounded head.

In one or more embodiments, the projections are arranged in rows and adjacent rows of the projections are offset from one another.

In one or more embodiments, the jewelry storage case further comprises a second portion having a first surface and a wall extending from a periphery of the first surface, a first side of the second portion hingedly connected to a first side of the first portion allowing relative pivotal movement between open and closed positions, wherein in the closed position the first and second portions define an enclosed space and in the open position the first and second portions are adjacent to one another.

In one or more embodiments, the jewelry storage case further comprises a securing mechanism selectively securing the first and second portions in the closed position.

In one or more embodiments, the jewelry storage case further comprises a zipper extending about and selectively securing remaining sides of the first portion to corresponding remaining sides of the second portion in the closed position.

In one or more embodiments, the jewelry storage case further comprises a blocking member positionable within the enclosed space and is dimensioned such that an end of each projection contacts the blocking member in the closed position.

In one or more embodiments, the blocking member is removable.

In one or more embodiments, the blocking member is connected to the first surface of the second portion and has a height greater than a height of the wall of the second portion.

In one or more embodiments, each projection has a height equal to a height of the wall of the first portion.

According to another aspect there is provided, a jewelry storage insert comprising a base having a generally planar surface; and a plurality of projections extending upward from the planar surface, the projections spaced apart from one another to receive a portion of jewelry.

In one or more embodiments, the projections extend upward from the planar surface perpendicularly.

In one or more embodiments, each projection comprises a body connected at one end to the planar surface.

In one or more embodiments, an opposite end of each projection comprises a rounded head.

In one or more embodiments, each projection extends through the base.

In one or more embodiments, each projection is formed integrally with the base.

In one or more embodiments, the projections are arranged in rows and adjacent rows of the projections are offset from one another.

In one or more embodiments, a distance between each projection is 0.5 cm and each projection has a height of 2 cm.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . and . . . " is intended to cover any one or more of the listed elements, including any one of the listed elements alone, any sub-combination, or all of the elements, without necessarily excluding any additional elements, and without necessarily requiring all of the elements.

Figure 2:
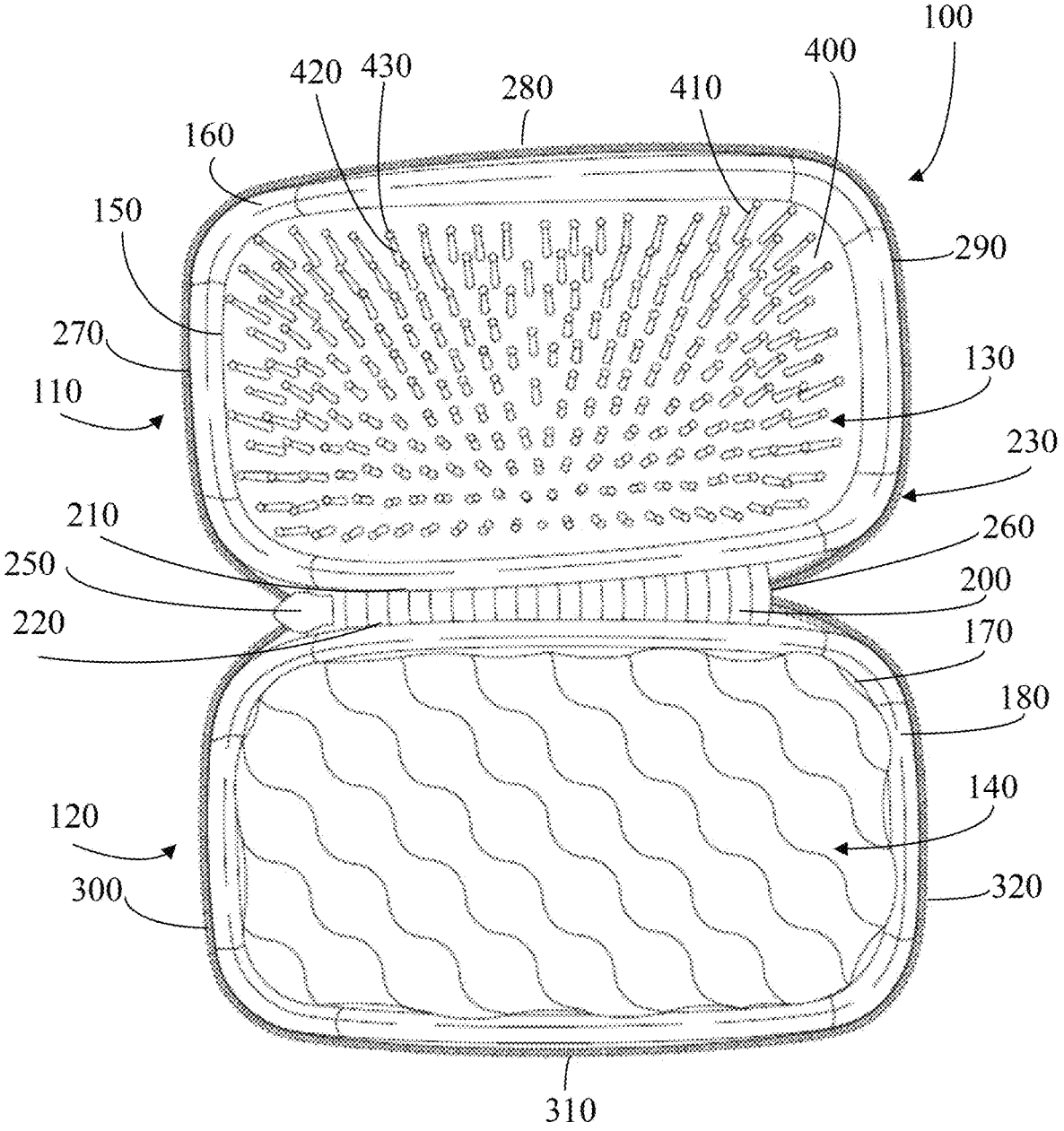
FIG. 2 is a top plan view of the jewelry storage case of FIG. 1 in an open position.
Figure 3:
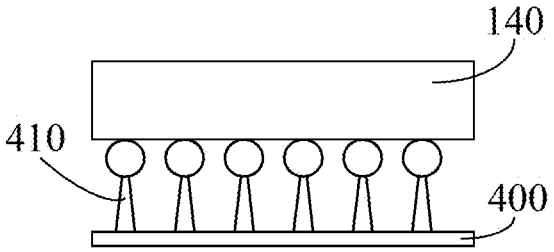
FIG. 3 is a cross-sectional view showing a portion of the jewelry storage case of FIG. 1 in the closed position.

Turning to FIGS. 1 to 3, a jewelry storage case is shown and is generally identified by reference numeral 100. FIG. 1 is an isometric view of the jewelry storage case 100 in a closed position. FIG. 2 is a top plan view of the jewelry storage case 100 in an open position. FIG. 3 is a zoomed in cross-sectional view showing a portion of the jewelry storage case 100 in the closed position. As can be seen, the jewelry storage case 100 comprises a first portion 110 hingedly connected to a second portion 120. A jewelry storage insert 130 is connected to the first portion 110 and a blocking member 140 is connected to the second portion 120.

The first portion 110 comprises a first surface 150 and a wall 160 extending from a periphery of the first surface 150. In this embodiment, the first surface 150 is generally rectangular shaped and has rounded corners. The first portion 110 is made of a rigid material such as for example molded plastic, wood, metal, rubber, etc. The exterior 165 of the first portion 110 may be covered with a material or aesthetically pleasing material such as for example leather, etc.

The second portion 120 is complimentary in shape to the first portion 110 and similarly comprises a first surface 170 and a wall 180 extending from a periphery of the first surface 170. In this embodiment, the first surface 170 is generally rectangular shaped and has rounded corners. The second portion 120 is made of a rigid material such as for example molded plastic, wood, metal, rubber, etc. The exterior 185 of the second portion 120 may be covered with a material or aesthetically pleasing material such as for example leather, etc.

The first portion 110 and the second portion 120 are hingedly connected to one another. In this embodiment, the hinge connection is defined by a material 200 connected to respective sides 210, 220 of the first and second portions 110, 120. When connected, the material 200 extends from side 210 of first portion 110 to side 220 of the second portion 120. The material 200 is made of an elastic material.

The hinge connection defined by material 200 permits relative pivotal movement of the jewelry storage case 100 between the open position (shown in FIG. 2) and the closed position (shown in FIG. 1). As shown in FIG. 1, in the closed position, the first portion 110 and the second portion 120 define an enclosed space. As shown in FIG. 2, in the open position, the first portion 110 and the second portion 120 are adjacent to one another.

A securing mechanism 230 is used to selectively secure the jewelry storage case 100 in the closed position. Put another way, the securing mechanism 230 is used to selectively secure the first portion 110 to the second portion 120 such that the jewelry storage case 100 can only be opened once the securing mechanism is released 230. In this embodiment, the securing mechanism 230 is in the form of a zipper 240. The zipper 240 connects at a first end 250 to the first and second portions 110, 120 at a location adjacent to an end of the material 200 and at a second end 260 to the first and second portions 110, 120 at a location adjacent to an opposite end of the material 200. The zipper 240 extends from the first end 250, about remaining sides 270, 280, 290 and 300, 310, 320 of the first and second portions 110, 120, respectively, and to the second end 260.

The jewelry storage insert 130 is connected to the first surface 150 of the first portion 110. In this embodiment, the jewelry storage insert 130 is not readily removable from the first surface 150 of the first portion 110. The jewelry storage insert 130 comprises a base 400 having a generally planar surface. The base 400 is made of a rigid material such as for example molded plastic, wood, metal or rubber. A plurality of projections 410 extend upward from the planar surface 400. Although not shown in FIG. 2, the plurality of projections 410 may be one hundred and twenty (120) projections. The projections 410 are equally spaced apart from one another at a distance to receive a portion of jewelry. As will be appreciated, in another embodiment the projections 410 may be spaced apart in a manner such that they are not equally spaced apart from one another. The projections 410 may be made of a rigid material such as for example molded plastic, wood, metal, rubber, etc.

In this embodiment, the projections 410 extend perpendicularly from the planar surface of the base 400. The projections 410 are arranged in rows. Adjacent rows of the projections 410 are offset from one another. As such, the projections are equally spaced apart at a distance of 0.5 cm.

Each projection 410 comprises a body 420 connected at a first end to the planar surface of the base 400. An opposite end of each projection comprises a rounded head 430. Each projection 410 is dimensioned to have a height equal to that of the wall 160 of the first portion 150. In this embodiment, each projection has a height of 2 cm.

The blocking member 140 is dimensioned to fit within a space defined by the first surface 170 and walls 180 of the second portion 120. In this embodiment, the blocking member 140 is made of a foam material and is connected to the first surface 170 using adhesive such as glue. The height of the blocking member 140 is set such that when the jewelry storage case 100 is in the closed position, the head 430 of each projection 410 contacts the blocking member 140. Put another way, the height of the blocking member 140 is greater than a height of the walls 180 of the second portion 120.

FIG. 3 is a cross-sectional view of a portion of the jewelry storage case in the closed position. As can be seen, when in the closed position, the base 400, the projections 410 and the blocking member 140 minimize or prevent the jewelry from moving around within the enclosed space such as for example during travel. For example, the projections 410 may minimize or prevent horizontal or side-to-side movement of the jewelry within the jewelry storage case 100. The projections 410, base 400 and blocking member 140 may minimize or prevent vertical or up-and-down movement of the jewelry within the jewelry storage case 100. As a result, entangling of the jewelry is minimized or prevented.

Figure 4:
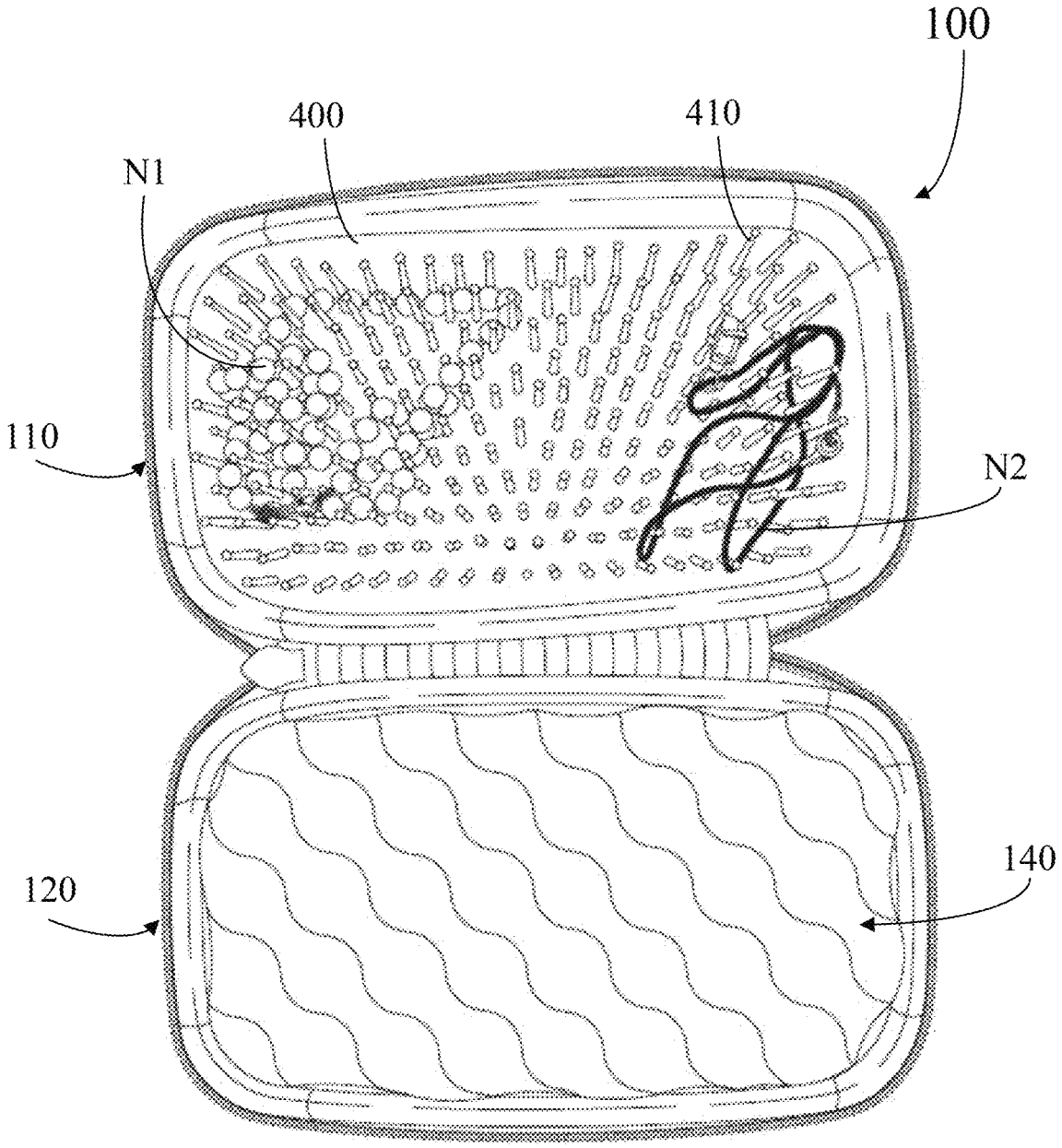
FIG. 4 is a top plan view of the jewelry storage case of FIG. 1 during use.
Figure 5:
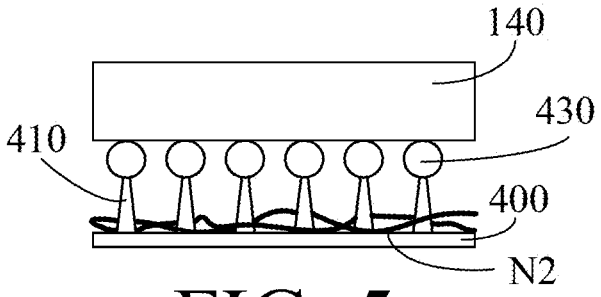
FIG. 5 is a cross-sectional view showing a portion of the jewelry storage case of FIG. 1 during use.

The operation of the jewelry storage case 100 will now be described with reference to FIGS. 4 and 5. During operation, when the jewelry storage case 100 is in the open position, jewelry such as for example necklaces, bracelets, anklets, rings and earrings may be dropped or placed into the first portion 110. As the jewelry is dropped or placed in the first portion 110, the jewelry is directed by the projections 410 and at least some of the jewelry comes to rest on the base 400. Example necklaces N1 and N2 are shown in FIGS. 4 and 5. It will be appreciated that other accessories may also be stored in the jewelry storage case 100 such as for example headphones, earphones, lanyards, mobile phone charging cords, etc.

As shown in FIG. 5, the jewelry storage case 100 is moved to the closed position and as such the blocking member 140 comes into contact with the head 430 of each projection 410. The zipper 240 is used to secure the jewelry storage case 100 in the closed position. The base 400, the projections 410 and the blocking member 140 minimize or prevent the jewelry from moving around within the enclosed space such as for example during travel. As such, entangling of the jewelry is minimized or prevented. Further, different pieces of jewelry will remain separated within the enclosed space.

Jewelry may be removed from the jewelry storage case 100 by using the zipper 240 to unsecure the jewelry storage case 100 and then moving the jewelry storage case 100 to the open position. The jewelry may then be lifted out from between the projections 410.

Figure 6:
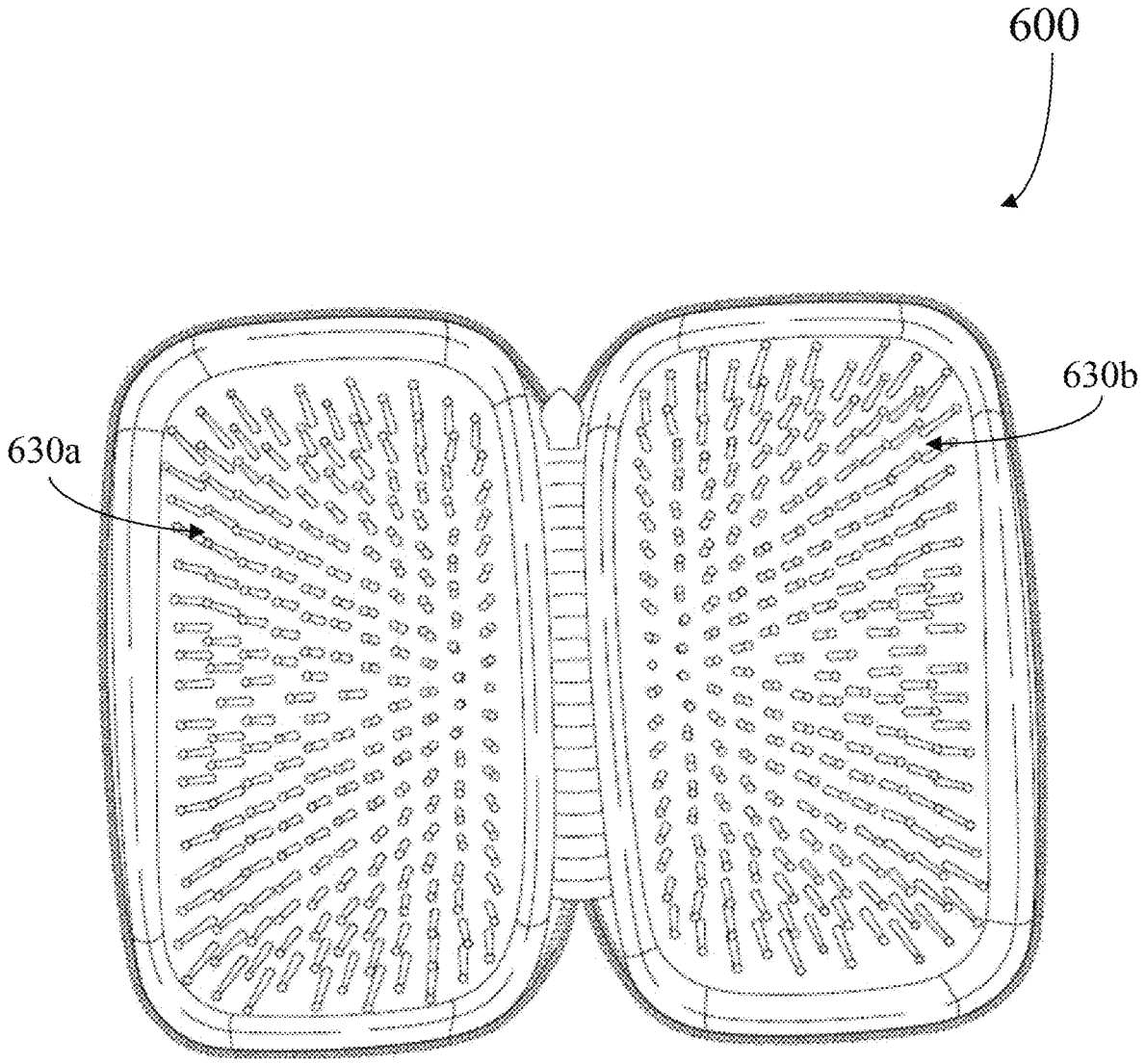
FIG. 6 is a top plan view of a jewelry storage case in an open position according to an exemplary embodiment.
Figure 7:
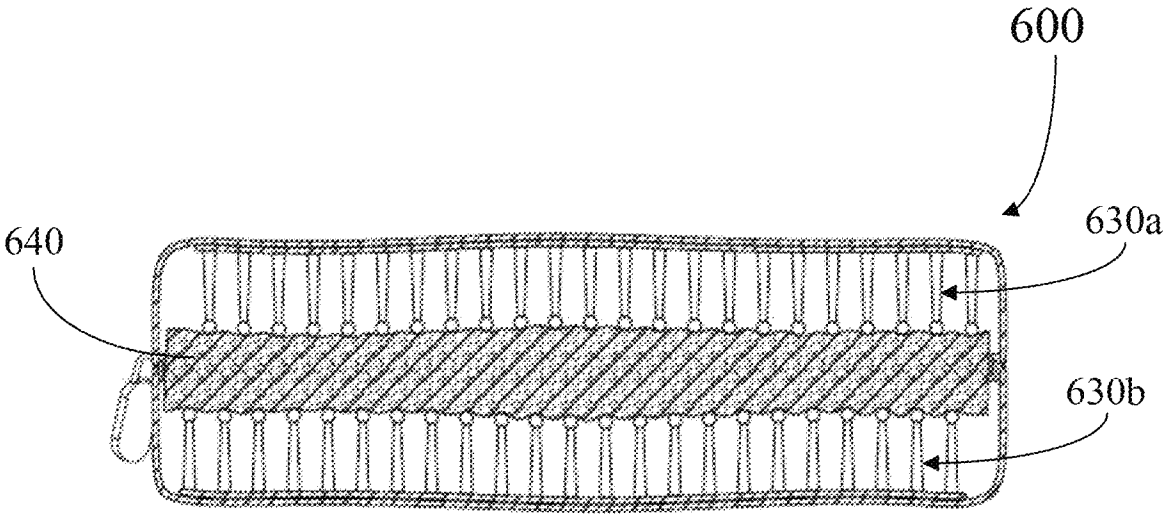
FIG. 7 is a cross-sectional view of the jewelry storage case of FIG. 6 in a closed position.

Although the jewelry storage case is described as having a jewelry storage insert 130, those skilled in the art will appreciate that in another embodiment a jewelry storage case 600 may have two (2) jewelry storage inserts 630*a* and 630*b* as shown in FIGS. 6 and 7. Jewelry storage case 600 is similar to jewelry storage case 100 describe above and jewelry storage inserts 630*a*, 630*b* are of the same type as jewelry storage insert 130 described above. In this embodiment, each jewelry storage insert 630*a*, 630*b* is positioned in a respective portion of the jewelry storage case 600. In this embodiment, a blocking member 640, similar to blocking member 140, is positioned such that it is located in-between the jewelry storage inserts 630*a*, 630*b* when the jewelry storage case 600 is in the closed position, as shown in FIG. 7.

Although the jewelry storage insert 130 is described as being connected to the jewelry storage case 100, in another embodiment the jewelry storage insert 130 may be removable from the jewelry storage case 100.

Figure 8:
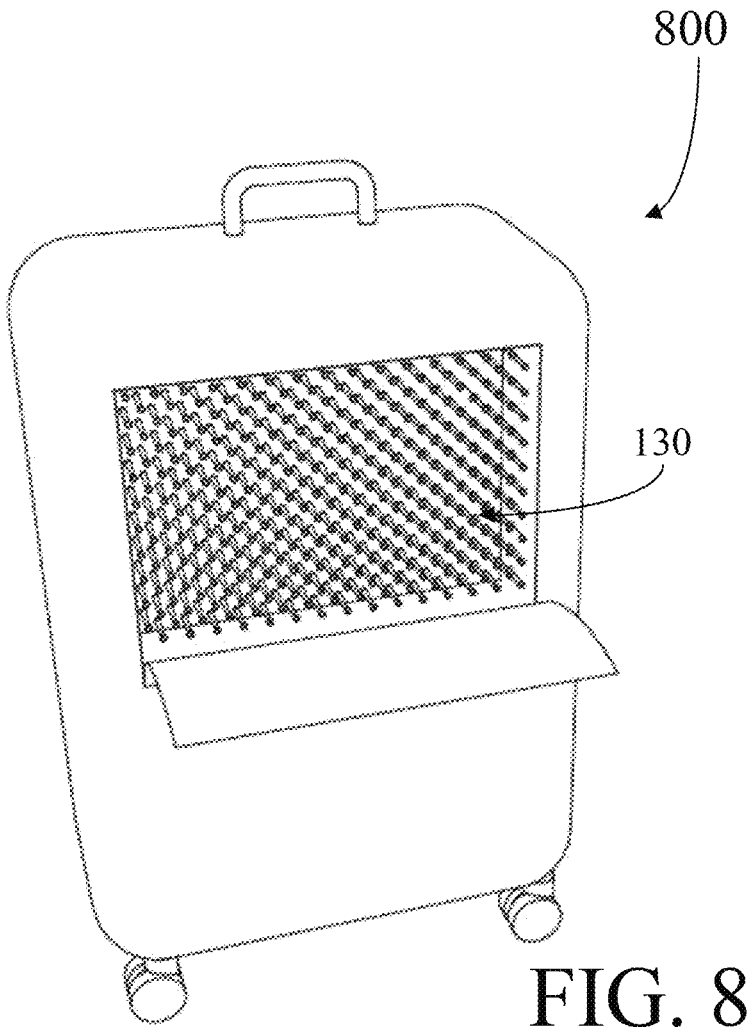
FIG. 8 is an isometric view of a jewelry storage insert in a suitcase.
Figure 9:
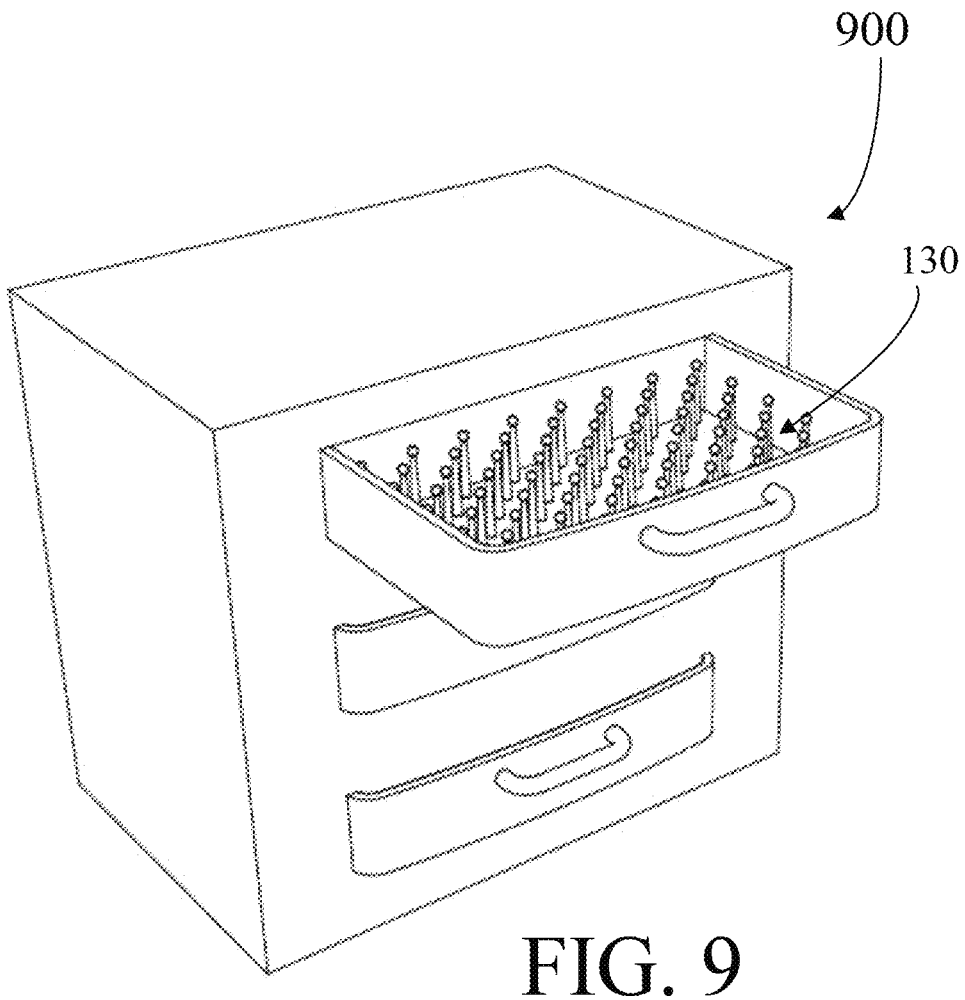
FIG. 9 is an isometric view of a jewelry storage insert in a drawer of a jewelry box.

The jewelry storage insert 130 may be used for jewelry storage in a number applications. For example, as shown in FIG. 8, the jewelry storage insert 130 may be used within a compartment of a suitcase 800. As shown in FIG. 9, the jewelry storage insert 130 may be placed in or used in a drawer 900 of a jewelry box. The jewelry storage insert 130 may additionally or alternatively be used in a drawer of a dresser, night table, etc. Although not shown in FIGS. 8 and 9, in these examples the blocking member is positioned in a manner similar to that described above.

Although the jewelry storage case 100 is described as having first and second portions being rectangular shaped with rounded corners, those skilled in the art will appreciate that any shape may be used, such as for example a round or circular shape, a square shape, a triangle shape, etc.

Although the securing mechanism 230 is described as being in the form of a zipper, those skilled in the art will appreciate that alternatives are available. For example, in another embodiment a snap and button mechanism may be used. In another embodiment, a Velcro strap may be used. In another embodiment, a clasp or magnetic clasp may be used.

Although the hinge connection is described as being defined by a piece of material such as elastic, those skilled in the art will appreciate that other types of hinge connections may be used such as for example a metal hinge, etc. In another embodiment, the hinge connection may permit the first and second portion from being detached from one another.

Although in embodiments the blocking member 140 is described as being positioned within the space defined by the first surface 170 and wall 180 of the second portion 120 and connected to the first surface 170, those skilled in the art will appreciate that alternatives are available. For example, in another embodiment the blocking member may be removable. In this embodiment, the blocking member may be placed within the space or on top of the projections 410. When the jewelry storage case 100 is closed, the blocking member 140 is held in place by the first surface 170 and walls 180 of the second portion 120. In another embodiment, the blocking member 140 may be hingedly connected to the material 200. The blocking member 140 may be made of any solid material. The blocking member 140 may have a shape equal to that of the first and second portions.

Although in embodiments the number of projections 410 is described as being one hundred and twenty (120), those skilled in the art will appreciate that any number of projections may be used.

Although in embodiments the projections are described as having the same height, those skilled in the art will appreciate that in some embodiments projections may have different heights to make removing the jewelry from the jewelry storage case easier.

Although in embodiments the projections are described as being equally spaced apart, those skilled in the art will appreciate that alternatives are available. For example, in another embodiment the jewelry storage case may have a first half of projections having one spacing and a second half of projections having a different spacing. In another embodiment, the spacing between projections may be variable.

Although in embodiments the projections are described as having a height of 2 cm and being spaced apart by 0.5 cm, those skilled in the art will appreciate that alternatives are available.

Although in embodiments, the projections are described as having a body with a rounded head, those skilled in the art will appreciate that the projections may have any shape.

Although in embodiments the projections are described as being connected to the planar surface of the base, those skilled in the art will appreciate that in another embodiment the projections may extend through the planar surface. In another embodiment, the projections may be unitary or integral with the planar surface.

Although in embodiments the projections are described as extending in a direction perpendicular to the planar surface, those skilled in the art will appreciate that the projections may extend at any angle from the planar surface.

As noted, certain adaptations and modifications of the described embodiments can be made. Therefore, the above discussed embodiments are considered to be illustrative and not restrictive.

What is claimed is:

1. A jewelry storage case comprising:

a first portion having a first surface and a wall extending from a periphery of the first surface;

a base having a planar surface and positioned on the first surface of the first portion;

a plurality of projections extending upward from the planar surface of the base, the projections spaced apart from one another to receive a portion of jewelry, each projection connected at a first end to the planar surface of the base and including a rounded head located at a second, opposite end thereof, the projections arranged in rows such that adjacent rows of the projections are offset from one another;

a second portion having a first surface and a wall extending from a periphery of the first surface, a first side of the second portion hingedly connected to a first side of the first portion allowing relative pivotal movement between open and closed positions;

a removable blocking member made of a solid material and connected to the first surface of the second portion, the removable blocking member having a height greater than a height of the wall of the second portion such that the rounded head of each projection contacts the removable blocking member in the closed position; and a securing member selectively securing the first portion and the second portion in the closed position.

2. The jewelry storage case of claim 1, wherein each projection extends upward from the planar surface perpendicularly.

3. The jewelry storage case of claim 1, wherein each projection comprises a body connected at one end to the planar surface.

4. The jewelry storage case of claim 1, wherein in the closed position the first and second portions define an enclosed space and in the open position the first and second portions are adjacent to one another.

5. The jewelry storage case of claim 1, wherein the securing member includes a zipper extending about and selectively securing sides of the first portion to corresponding sides of the second portion in the closed position.

6. The jewelry storage case of claim 1, each projection has a height equal to a height of the wall of the first portion.

7. The jewelry storage case of claim 1, wherein the projections are equally spaced apart at a distance of 0.5 cm.

8. The jewelry storage case of claim 1, wherein each projection has a height of 2 cm.

9. A jewelry storage case comprising:

a first portion having a first surface and a wall extending from a periphery of the first surface;

a base having a planar surface and positioned on the first surface of the first portion;

a plurality of projections extending upward from the planar surface of the base, the projections spaced apart from one another to receive a portion of jewelry, each projection connected at a first end to the planar surface of the base and including a rounded head located at a second, opposite end thereof, the projections arranged in rows such that adjacent rows of the projections are offset from one another;

a second portion having a first surface and a wall extending from a periphery of the first surface, a first side of the second portion hingedly connected to a first side of the first portion allowing relative pivotal movement between open and closed positions;

a blocking member made of a solid material and connected to the first surface of the second portion, the blocking member having a height greater than a height of the wall of the second portion such that the rounded head of each projection contacts the blocking member in the closed position; and a securing member selectively securing the first portion and the second portion in the closed position.

10. The jewelry storage case of claim 9, wherein each projection extends upward from the planar surface perpendicularly.

11. The jewelry storage case of claim 9, wherein each projection comprises a body connected at one end to the planar surface.

12. The jewelry storage case of claim 9, wherein in the closed position the first and second portions define an enclosed space and in the open position the first and second portions are adjacent to one another.

13. The jewelry storage case of claim 9, wherein the securing member includes a zipper extending about and selectively securing sides of the first portion to corresponding sides of the second portion in the closed position.

14. The jewelry storage case of claim 9, each projection has a height equal to a height of the wall of the first portion.

15. The jewelry storage case of claim 9, wherein the projections are equally spaced apart at a distance of 0.5 cm.

16. The jewelry storage case of claim 9, wherein each projection has a height of 2 cm.

17. The jewelry storage case of claim 9, wherein the blocking member is removable.

* * * * *